United States Patent [19]

Iversen

[11] Patent Number: 4,684,844

[45] Date of Patent: Aug. 4, 1987

[54] LIQUID COOLED STATIONARY ANODE TUBES

[76] Inventor: Arthur H. Iversen, 15315 Sobey Rd., Saratoga, Calif. 95070

[21] Appl. No.: 635,842

[22] Filed: Jul. 30, 1984

[51] Int. Cl.[4] ..... A47B 81/00

[52] U.S. Cl. ..... 313/30; 313/35; 313/36

[58] Field of Search ..... 313/30, 32, 35, 39, 313/22, 24, 36; 378/141, 142

[56] References Cited

U.S. PATENT DOCUMENTS

| | | | |
|---|---|---|---|
| 1,874,478 | 8/1932 | Fayer | 313/142 |
| 2,118,413 | 5/1938 | Mesnick et al. | 378/141 |
| 2,900,541 | 8/1959 | Bondley et al. | 313/32 |
| 3,306,350 | 2/1967 | Beurtheret | 313/24 |
| 3,402,766 | 9/1968 | van Loo et al. | 313/35 |
| 3,866,085 | 2/1975 | James | 313/22 |
| 3,876,901 | 4/1975 | James | 313/30 |
| 4,455,504 | 6/1984 | Iversen | 313/35 |

FOREIGN PATENT DOCUMENTS

| | | | |
|---|---|---|---|
| 1250015 | 9/1967 | Fed. Rep. of Germany | 313/35 |
| 2102405 | 7/1971 | Fed. Rep. of Germany | 313/24 |
| 2813935 | 10/1979 | Fed. Rep. of Germany | 313/32 |
| 0316933 | 12/1956 | Switzerland | 378/141 |

*Primary Examiner*—David K. Moore
*Attorney, Agent, or Firm*—Foley & Lardner

[57] ABSTRACT

There is disclosed a liquid cooled stationary anode tube wherein the anode is adapted for irradiation by an energy beam, and includes a heat exchange surface, said tube includes means for providing a flow of coolant liquid to remove heat from said heat exchange surface by formation of nucleate vapor bubbles on said heat exchange surface, said liquid tending to include a viscous sublayer adjacent to said heat exchange surface, the improvement wherein said heat exchange surface includes at least one of: means for forming pressure gradients in said liquid having a component prependicular to said heat exchange surface to facilitate removal of said nucleate bubbles; and means for breaking up said viscous sublayer to facilitate removal of said nucleate bubbles, and wherein said heat exchange surface comprises a series of curved surfaces, each adjacent the next said curved surfaces being generally circular symmetric about the central axis of said anode and wherein septum members with corresponding curved surfaces, which may be split to permit positioning into close proximity to said heat exchange surface to provide desired coolant flow characteristics over the surfaces of the anode heat exchange surface, said septum members being bonded to axial structure elements that fasten to end members mounted on said anode whereby support is provided to said septum members, desired liquid flow patterns are obtained and rigidity is provided the hot, thin walled anode during operation thereby preventing collapse and obtaining minimal thermal stress through the anode wall.

26 Claims, 11 Drawing Figures

F-F

LIQUID COOLED STATIONARY ANODE TUBES

DESCRIPTION

1. Technical Field

The present invention relates to stationary anode electron tubes of relatively high power output and particularly concerns means for the efficient cooling of the anode of such tubes.

2. Background of the Invention

Types of power tubes in which the invention finds utility include external anode power tubes such as diodes, triodes, tetrodes and pentodes, and klystrons, traveling wave tubes and magnetrons. The dissipation of the impinging electron beam power on the anode of electron tubes is often one of the limitations of tube performance of the above tube types. Prior art regarding the liquid cooling of stationary anodes includes U.S. Pat. Nos. 3,227,904 issued 1/4/66 to M. E. Levin; 3,246,190 issued to 4/12/66 to Boyd et al; 3,289,022 issued 11/29/66 to H. Oberlander; 3,305,742 issued 2/21/67 to E. W. McCune; 3,348,088 issued 10/17/67 to S. E. Allen Jr.; 3,365,601 issued 1/23/68 to H. D. Doolittle; 3,500,096 issued 3/10/70 O'Loughlin et al; 3,526,798 issued 9/1/70 to L. H. Sandstrom; 3,585,429 issued 6/15/71 to O'Loughlin et al and 3,601,647 issued 8/24/71 to F. G. Hammersand. The above cited patents have several elements in common, the most important being that coolant flow is linear and is generally directed axially along the outer anode surface. Linear flow of coolant provides a typical maximum power rating of 500 W/cm$^2$ dissipation as is currently practiced. Higher power is obtained only with excessive pressures. Another common feature is that the anode coolant surface is often prepared with numerous axially directed coolant channels uniformly spaced around the circumference of the anode. The numerous slots or holes to be milled or drilled for the coolant channels can add substantially to the manufacturing cost of the anode. Moreover, the essentially unsupported nature of anode construction typically practiced, both axially and circumferentially, combined with the soft condition of the copper anode due to high temperature brazing during manufacturing operations require a thickening of the anode wall in order to provide adequate strength to prevent collapse which can occur when operated at maximum power. The use of high pressure liquid coolant designs further increases the potential for anode collapse. The use of thicker anode walls increases anode weight and most important it increases the temperature drop through the anode wall thereby increasing thermal stresses on the anode. This results in shorter tube life as well as reducing peak powers that are permissible. Anodes in high power Klystrons can weight up to 200 pounds and require large and strong insulating ceramics to withstand the shock and vibration of shipping, handling and hostile environments such as shipboard.

SUMMARY OF THE INVENTION

The present invention provides a liquid cooled anode that can dissipate power densities (heat flux) that are an order of magnitude greater than currently available.

The present invention also provides a rigid, self-supporting liquid cooled anode that permits an arbitrarily thin anode wall to be fabricated thereby minimizing thermal stress across the anode wall, increasing tube life and preventing anode collapse.

The present invention further provides a liquid cooled anode that may be operated at optimum liquid coolant flow rates and at low pressures.

The present invention provides a liquid cooled anode that is smaller and lighter than has heretofore been possible.

The foregoing is accomplished in accordance with the present invention by providing a liquid cooled stationary anode tube comprising:

a. a vacuum envelope:

b. a hollow stationary anode assembly generally circular symmetric about its axis and means for effective liquid cooling of the external surface of said anode at a heat exchange surface;

c. an electron source enclosed within said vacuum envelope said electron source oriented such that the electron beam emitted from said electron source impinges on a predetermined region of the inside surface of said anode;

d. wherein said anode heat exchange surface is provided with periodic curves, said curves being one or more in number and wherein the axis of said anode, said curves and their origins and the velocity vectors of said liquid lie generally in the same plane said plane being any one of an infinite number of planes passing through the axis of said anode and wherein a liquid coolant diverter is structured in the anode heat exchange region to provide predetermined liquid flow conditions and said liquid flow generating a pressure gradient having a component perpendicular to the anode heat exchange surface by virtue of said liquid coolant flow interacting with said curved surface of the anode, and wherein each said period or curve is provided with ducting for the alternate injection and removal of said coolant, said ducting means providing precise, low pressure drop coolant flow over said anode heat exchange surface and, in addition, enables rigid support for optimum thin wall anode geometry.

DESCRIPTION OF THE DRAWINGS

FIG. 7 A—A is a complete cross-sectional view of the threaded hose connection;

FIG. 7 B—B is a complete cross-sectional view of the transition conduit showing the transition from the circular hose connection to the semi-circular body of the outer liquid flow jacket, showing as well fin or vane flow diverters;

FIG. 7 C—C is a complete cross-sectional view of the juncture of the transition conduit with the semi-circular anode conduit, also showing sealing means such as elastomer gaskets;

FIG. 7 D—D is a complete cross-sectional view of the semi-circular conduit, also showing sealing means such as elastomer gaskets;

FIG. 7 E—E is a complete cross-sectional view of the termination of semi-circular anode conduit, also showing sealing means such as elastomer gaskets;

DETAILED DESCRIPTION OF PREFERRED EXEMPLARY EMBODIMENT

Figure 1:
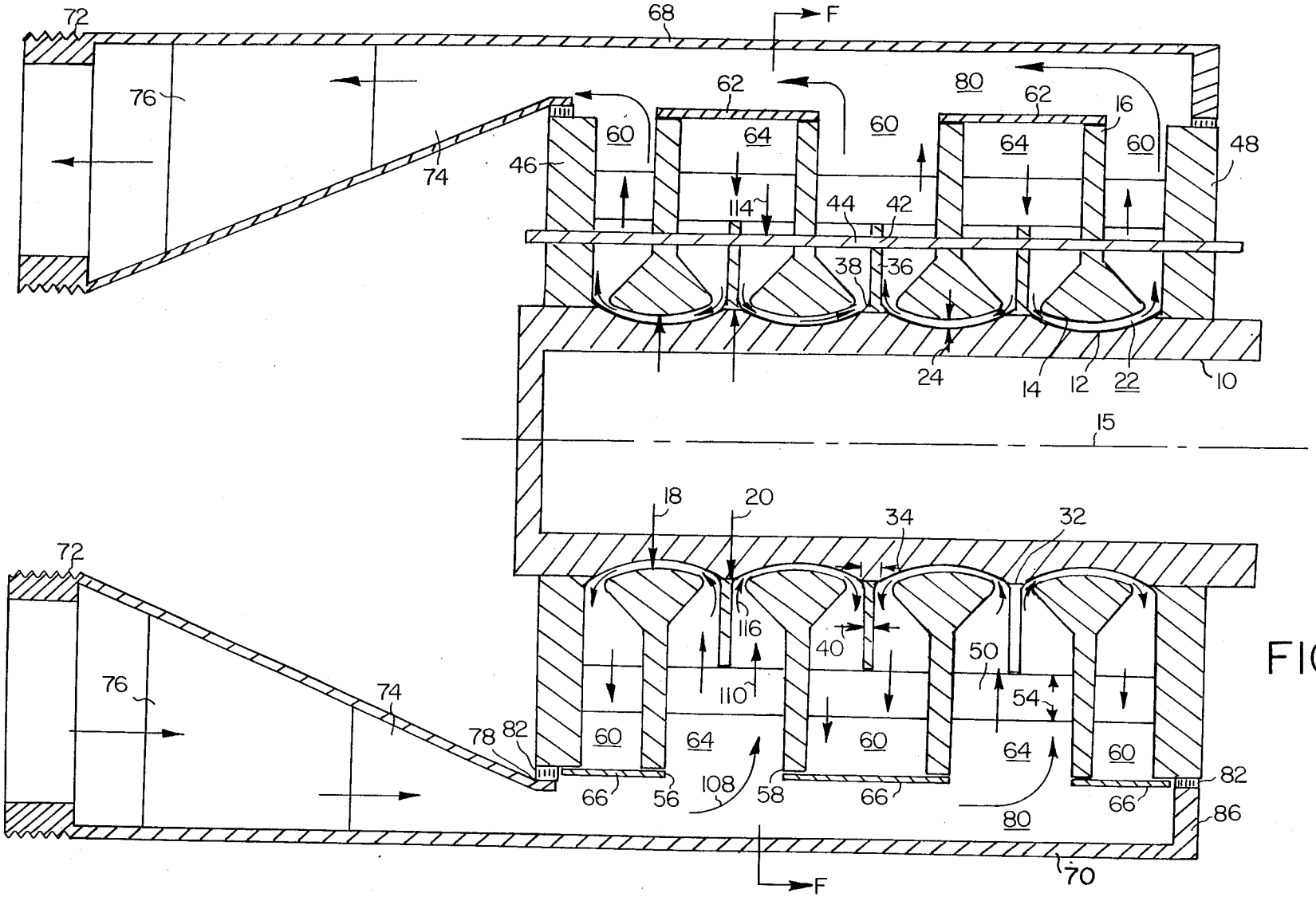
FIG. 1 is a complete cross-section view of a multi-curved surface of a liquid cooled anode containing all conduit elements for liquid flow according to the present invention.

U.S. Pat. No. 4,455,504 issued June 19, 1984 to Iversen describes means whereby the anodes of high power electron tubes may be cooled in an efficient manner. The present invention addresses a further preferred embodiment of FIG. 16 of the above cited invention which is generally described in Column 19, lines 49–68 and Column 20, lines 1–61. FIG. 16 of the above cited patent illustrates the general design of a liquid cooled stationary anode tube comprising:

a. a vacuum envelope:

b. a hollow stationary anode assembly generally circular symmetric about its axis and means for effective liquid cooling of the external surface of said anode at a heat exchange surface;

c. an electron source enclosed within said vacuum envelope said electron source oriented such that the electron beam emitted from said electron source impinges on a predetermined region of the inside surface of said anode;

d. said anode heat exchange surface is provided with periodic curves, said curves being one or more in number and wherein the axis of said anode, said curves and their origins and the velocity vectors of said liquid lie generally in the same plane said plane being any one of an infinite number of planes passing through the axis of said anode and wherein a liquid coolant diverter is structured in the anode heat exchange region to provide predetermined liquid flow conditions and said liquid flow generating a pressure gradient having a component perpendicular to the anode heat exchange surface by virtue of said liquid coolant flow interacting with said curved surface of the anode;

e. wherein said anode is further provided with means wherein each of said period or curve is provided with ducting for the alternate injection and removal of said coolant.

The viscous or laminar sublayer—a thin layer of laminar flow adjacent to the wall of the conduit and always present in turbulent flow—provides a mechanism to cause the nucleate bubbles to adhere more readily to the anode surface. The rate of nucleate bubble removal may be increased by breaking up this viscous or laminar sublayer. As described in U.S. Pat. No. 4,405,876 issued 9/20/83 to A. Iversen, such viscous sublayer can be broken up by roughening the anode coolant surface. When the height of the roughening projections ranges from 0.3 times the thickness of the viscous sublayer to about twice the thickness of the viscous sublayer and transition zone, the sublayer is substantially broken up. Breaking up the viscous sublayer enables the turbulent fluid to reach the base of the nucleate bubble, where it is attached to the anode, thereby providing additional energy needed to break it loose. The geometry of nucleate bubbles is a function of the surface roughness geometry; small fissures or cavities tend to generate small nucleate bubbles, whereas large cavities tend to generate larger one. Therefore, nucleate bubble size and generation can be optimized by providing a surface of calculated and preferably uniform roughness and geometry. The dimensions of the cavitites and their spacing on the anode heat exchange surface is such that for given coolant operating parameters, nucleate bubbles of optimum sizes and distribution are formed such that under the condition of maximum heat flux, film boiling does not take place while obtaining maximum heat flux transfer and the highest critical heat flux. A regular roughness goemetry can be obtained by suitable conventional techniques such as, for example, chemically by means of chemical milling; electronically, by the use of lasers or electron beams; or mechanically, by broaching, hobbing, machining, milling, stamping, engraving, etc.

Another method of obtaining a surface with crevices for forming nucleate bubbles is the use of a thin porous metal layer adherent to the anode at the anode heat exchange surface. This porous metal layer may be considered to provide a contoured surface as defined above. Relatively uniform pore size can be obtained by fabricating the porous structure from metal powders with a narrow range of particle sizes. Methods, such as described in U.S. Pat. No. 3,433,632 issued to Ebbertotal on Mar. 18, 1969, are well suited to provide the desired metal structure.

To be described is a structure whereby the multiple curved surface heat exchange elements on the external surface of the anode of an electron tube may be structually connected in parallel with regard to coolant flow wherein low thermal stresses are maintained across a thin anode wall while maintaining mechanical rigidity, and thereby avoid mechanical collapse during the dissipation of high heat fluxes.

Referring now to FIG. 1, shown is an anode 10 with a multiplicity of adjacent curved heat exchange surfaces 12, said heat exchange surfaces corresponding to heat exchange surfaces 186, 188 and 190 of FIG. 16 of U.S. Pat. No. 4,455,504. Again referring to FIG. 1 of the present invention, septum elements 16, which may also be called liquid coolant diverters, containing curved liquid flow diverter surfaces 14 are brought into close proximity to curved anode heat exchange surfaces 12 such that a curved liquid flow conduit 22 results. Curved surfaces, anode 12 and septum 14, are generally circular symmetric about anode axis 15. Height 24 of conduit 22 is generally constant, but may be varied by changing the curvature of either the anode surface 12 or septum surface 14, or both. In this manner, the heat transfer characteristics, as the combination of anode heat exchange surface curvature and liquid flow velocity may be varied and thereby optimized for different segments of the anode heat exchange surface. Curved flow diverter surfaces 14 of septum elements 16 correspond to curved surfaces 192, 194 and 196 of FIG. 16 of U.S. Pat. No. 4,433,504.

In general, conduit height 24 is small and the required inside diameter 18 of septum element 16 may be smaller than the outside diameter 20 of the anode. Thus, there is an interference fit when attempting to slide septum element 16 over anode 10.

Therefore, in order to position curved liquid diverter surfaces 14 into proper relationship with curved anode heat exchange surfaces 12, septum elements 16 must be cut into 2 or more pieces so that they may be brought into proper relative position as shown in FIG. 1.

Figure 2:
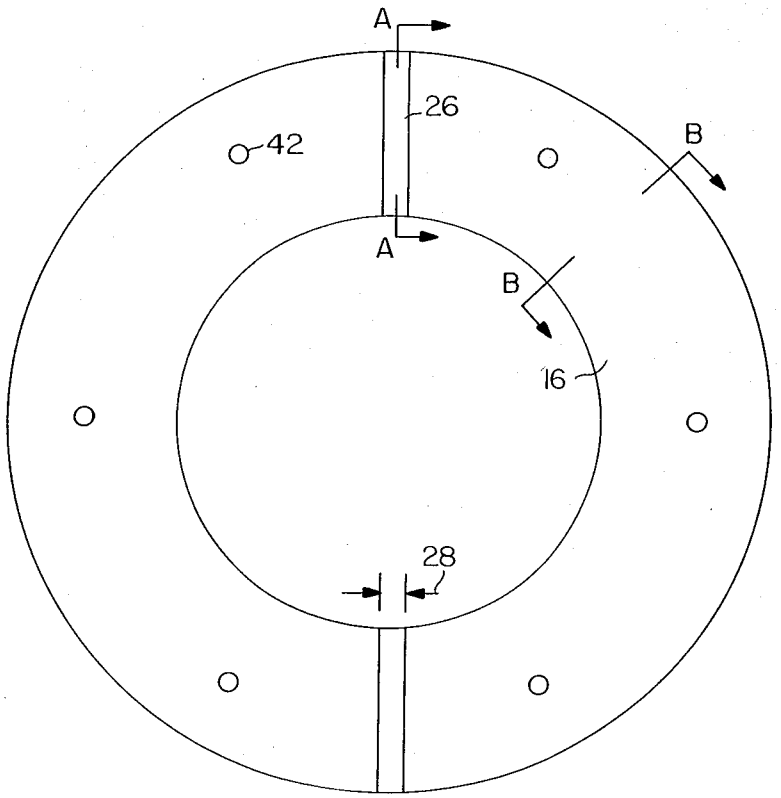
FIG. 2 is a complete frontal view of a flow diverter.
Figure 3:
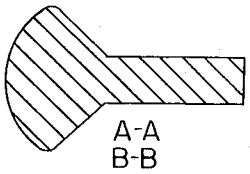
FIG. 3 is a partial cross-sectional view of a flow diverter showing the curved surface that is in close proximity to the curved anode heat exchange surface.

FIG. 2 provides a complete front view of septum element 16 illustrating a cut of width 28 to divide it into 2 parts so the two pieces may be brought in radially and positioned about the anode. Slot 28 has placed in it a replacement element 26 of thickness 28 equal to the slot width 28. The shape of replacement element 26, FIG. 2 A—A, is identically the same as a cross-section, FIG. 2 B—B, of the septum 16 as shown in FIG. 3. The number of replacement elements 26 required equals the number of parts the septum 16 is cut into. Replacement elements 26 may be mounted on each of the septum sections 16 by adhesives, brazing, welding, screws etc. or may be inserted as a step in the assembly of the ducting system. When brought together, septum sections 16 once again form a circle upon insertion of replacement element 26.

Again referring to FIG. 1, the assembly of the liquid coolant ducting system proceeds as follows. Anode 10 is provided with a series of curved heat exchange surfaces 12, shown here as flutes with flattened cusps 32, the width 34 of the flat region being small compared to the arc length of the fluted heat exchange surface 12. Washers 36, having an inside diameter slightly larger than the outside diameter 20 of the anode and a thickness at the inside diameter corresponding to the width 34 of the flat region of anode 10, extending radially outward from the cusps 32.

Curved surfaces 38 are provided on both sides of washer 36, the thickness stabilizing at a value 40 which is less than its thickness 34 at the inside diameter.

Washer 36, which is joined to anode 10 at each of the flattened cusps 32, serves three important functions. First, it serves as a spacer between adjacent septum elements 16 and thereby prevents any liquid flow oscillations that might occur which could send more liquid over one flute element (anode heat exchange surface 12) than its neighbor which is fed by the same flow. This reduction in flow could cause premature burn-out in the fluid starved flute element (heat exchange surface). Secondly, washers 36, which are placed over and bonded circumferentialy to each flattened cusp 32 of anode 10, serve mechanically to circumferentially stiffen the anode against collapse in the radial direction. This permits the anode wall to be very thin thereby reducing thermal stress through the anode wall and permitting high heat flux, i.e. power, to be achieved. Thirdly, washers 36 are precision drilled with holes 42 at periodic circumferential intervals through which axial support rods 44 are inserted. Axial support rods 44 serve as mounting elements for septum 16. Septum 16 is also precision drilled with holes 42. FIG. 2 also shows holes of diameter 42 in septum 16. As can be seen, septum 16 has 3 holes in each of the two segments to accept a total of 6 support rods.

Again returning to FIG. 1, axial support rods 44 serve two important functions. First they serve as mounting means for septum elements 16 whereby the axial and radial positioning of curved flow diverter surface 14 is maintained in precise relationship to curved anode heat exchange surfaces 12. Second, axial support rods 44 serve as mechanical stiffening means for the anode 10 in the axial direction in conjunction with multiple washers 36 and end plates 46 and 48, which are bonded by adhesives, brazing, tack welding etc. to axial rods 44, a rigid self supporting structure is formed that is structurally independent of the anode 10. Thus, the anode wall thickness may be made as thin as desired to optimize tube output power with substantially reduced concern for anode collapse when operated at high power levels. Axial support rods 44 pass through holes 42 in end plate 48, through holes 42 in multiple washers 36, and then through holes 42 in opposite end plate 46. Precise tolerances are maintained regarding the diameter and positioning of holes 42 in end plates 46 and 48 and washers 36. It is these tolerances that insure that conduit 22 is within precise tolerances. Precise axial alignment of septum 16 is obtained with spacers during the bonding of septum 16 to axial support rods 44. Other shapes for support rod 44 may be used such as thin metal strips positioned radially to minimize coolant turbulance.

In general end plates 46, 48 and multiple washers 36 are brazed to anode 10. This assures maximum strength and mechanical rigidity, and good thermal conductivity. Since these parts are external to the vacuum envelope, material selection is not critical. To match coefficients of expansion as well as retain high thermal conductivity and good corrosion resistance, dispersion strengthened copper may be used, such as those alloys with small amounts of zirconium or chromium or alumina or berylium or silver. These coppers have high strength at elevated temperatures. In general, parts 46, 48 and 36 are immersed in liquid coolant and so do not operate at elevated temperatures. If matching coefficients of expansion is desirable, axial support rods 44 should also be made of the same copper material. For galvanic corrosion inhibition reasons, septum 16 may also be made from the same copper material. Other suitable corrosion resistant materials include monels, brass, stainless steels etc. Bonding of septum 16 to axial support rods 44 may be by adhesives, brazing, tack welding etc. Thus, the anode coolant ducting subassembly, (FIG. 1) contains end plates 46, 48 washers 36, and septum elements 16 all joined together by axial support rods 44.

Figure 4:
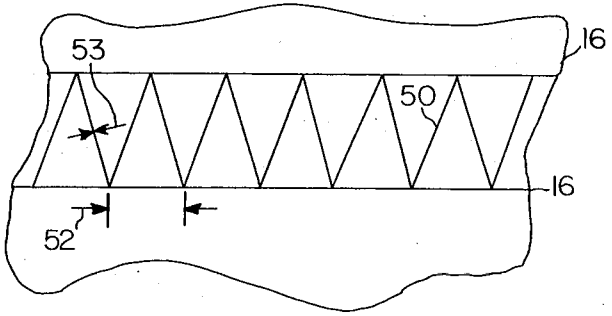
FIG. 4 is a partial side view of a radial liquid flow diverter, hereinafter sometimes called a RF diverter, spaced between adjacent flow diverters.

Radial liquid flow diverter 50 is positioned between adjacent septum elements 16 to insure a radial flow of coolant by substantially removing any circumferential component of velocity. FIG. 4 shows a partial side view of radial flow diverter 50 positioned between adjacent septum elements 16. Radial flow diverters, generally having the appearance of fins, are made of thin metal and for ease of manufacture may be folded into an accordian "V" pleat for ease of insertion. Other shapes, such as a "U" shape, may be advantageous. The circumferential pitch 52 should be small compared to the radial length 54 (FIG. 1) to insure substantial removal of any circumferential component of velocity in the liquid as it flows radially toward heat exchange conduit 22. Radial flow diverter 50 may be supported by the peripheral surface of washer 36 or axial support rod 44. Radial flow diverter 50 may be bonded to septum elements 16 and end plates 46 and 48 by adhesives, brazing, i.e. low temperature silver zinc, or tack welding. In general, axial support rods 44 are positioned sufficiently radially distant from heat exchange conduit 22 such that any liquid flow irregularities have been substantially smoothed out upon entering conduit 22.

Figure 6:
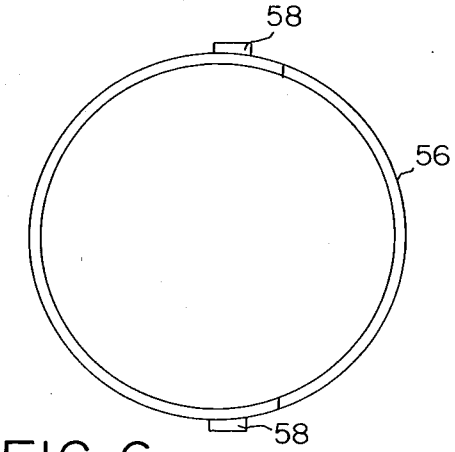
FIG. 6 is a complete end view of the IO diverter.
Figure 5:
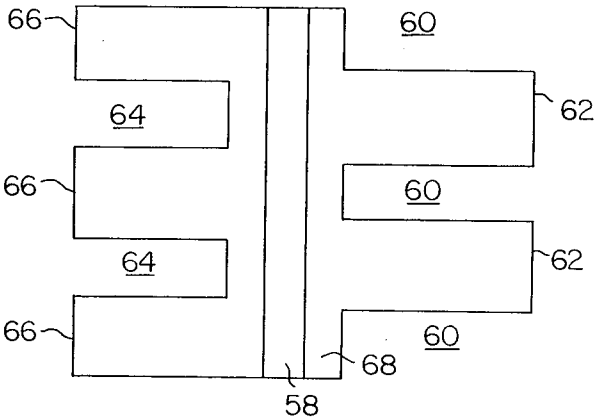
FIG. 5 is a complete top view of the input-output (IO) liquid flow diverter, hereinafter sometimes called IO diverter, used to isolate the incoming liquid from the outgoing liquid in the region where the direction of liquid flow changes from axial to radial for incoming coolant and, radial to axial for outgoing coolant.

Cylindrical input-output liquid flow diverter 56 (IO diverter) containing circumferential slots of less than 180° is slipped over end plates 46, 48 and septum elements 16. The inside diameter of cylindrical IO diverter is a close fit to the outside diameters of end plates 46, 48 and septum element 16 so that where they overlap 58 they may be joined by adhesives, brazing etc. Joints at 58 need not be hermetic but should be sufficient to keep leakage between adjacent chambers within acceptable limits. FIG. 5 is a complete side view of the IO diverter 56 corresponding to the cross-section shown in FIG. 1. FIG. 6 is an end view of the cylindrical IO diverter. It should be noted the cylindrical construction of the IO diverter is shown for ease of illustration. Curved strips of sheet metal, each greater than 180° to provide the needed overlap for the axial elastomer seal, may be laid down such that the same result is obtained. The upper slots of FIG. 5 and FIG. 1 define a conduit 60 through which the heated coolant transitions from radial to axial flow to be discharged. Approximately semi-cylindrical bands 62 seal off intermediate conduits 64 defined by adjacent septum elements 16. Axial solid strip 68 with elastomer sealing means 58 serves to isolate input coolant conduit jacket from the output coolant conduit jacket (FIG. 5). Again referring to FIG. 5 and FIG. 1, the lower slots define conduits 64 through which input coolant transitions from axial to radial flow towards the anode heat exchange conduit 22. Again, approximately semicylindrical bands 66 seal off the coolant discharge conduits 60 defined by adjacent septum elements 16.

Figure 10:
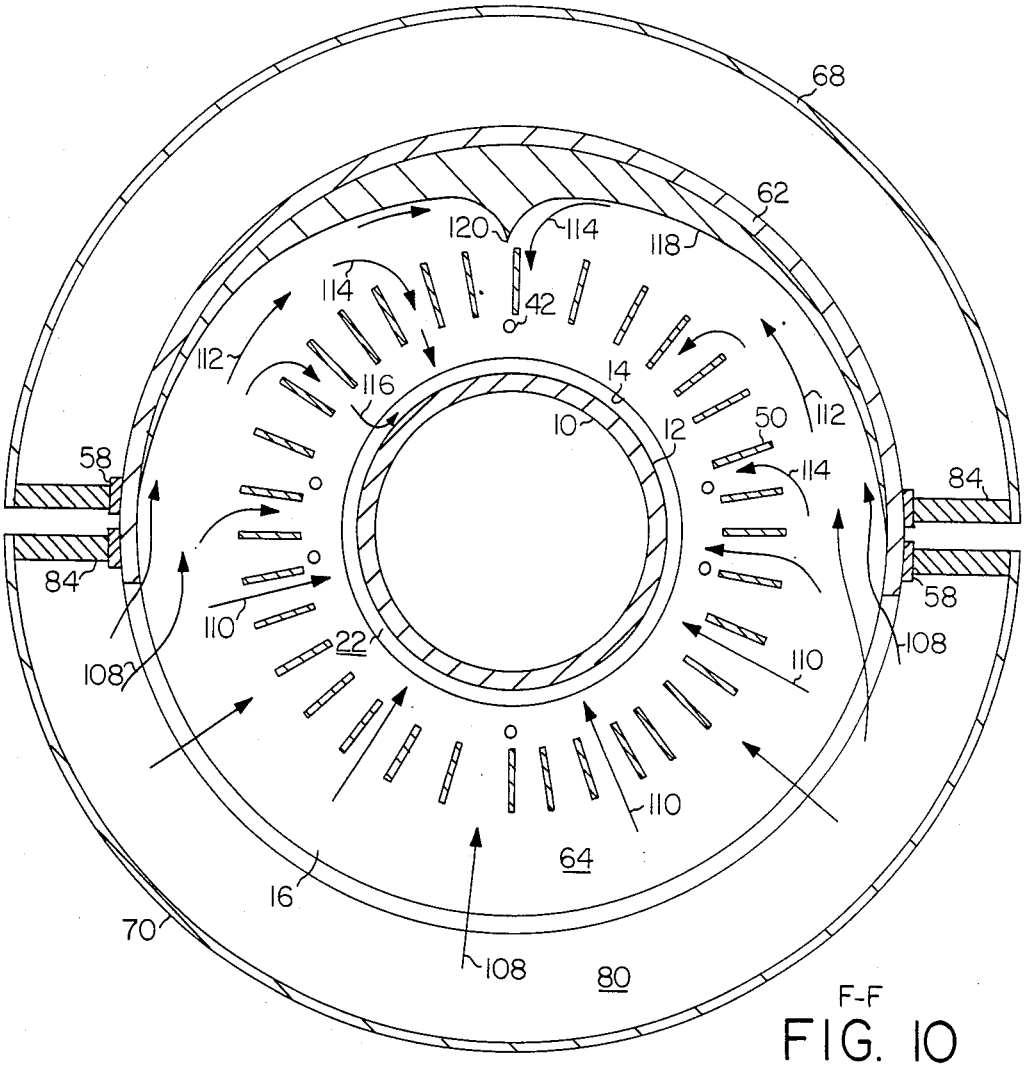
FIG. 10 is a full cross-section view F—F of FIG. 1 illustrating the transition from axial flow to radial flow prior to passing through the anode heat exchange region; and, FIG. 11 is a complete cross-sectional view of a multi-segmented depressed collector (anode) containing all conduit elements for liquid flow according to the present invention.

FIG. 10 provides the full cross-sectional view F—F of FIG. 1 illustrating incoming liquid coolant flow as it transitions from axial flow to the desired 360° radial flow prior to passing through the anode heat exchange region. Referring now to FIG. 10,incoming coolant flow, arrows 108, are shown entering radial input conduit 64 from axial flow input conduit 80 of axial flow input jack 70. For the almost semi-circular input region of 64 corresponding to conduit 80, coolant flow is substantially radial inward, as shown by arrows 110. The other approximately semi-circular input region 64 corresponding to IO diverter band 62, the coolant flows circumferentially, arrows 112, and then transitions to radial flow, arrows 114, while passing through radial flow diverters 50. The coolant, arrow 116, then passes through the anode heat exchange region 22.

From each extreme of axial flow input conduit 80, approximately 180° apart, the coolant flow travels approximately 90° to meet at the middle of IO diverter band 62. This 90° essentially represents the minimum practical circumferential distance coolant must travel prior to inward radial flow. As previously discussed, by maintaining input region 64 large compared to heat exchange region 22, the relative pressure drop in region 64 is relatively small, and thus liquid flow rates are substantially 360° uniform in region 22. Alternately, or in combination, liquid flow diverter 118 may be used to vary the coolant flow characteristics as they travel circumferentially under IO diverter band 62. As liquid feeds into the heat exchange region 22 as shown by arrow 116, the circumferential coolant velocity decreases and reaches its minimum at the mid-point of IO diverter band 62 where the last of the liquid has been directed radially inward. Liquid flow diverter 118 is seen to progressively decrease the cross-section of input region 64 under IO diverter band 62, reaching a minimum at mid-point 120. By decreasing or varying the cross-section of region 64 under IO band 62 with diverter 118, the liquid velocity may be kept constant, increased or decreased in this region. This compensates for the liquid being progressively fed through that approximately 180° (90° from each side) of heat exchange region 22 that is under IO band 62. Thus, optimum flow characteristics may be obtained.

The cross-section shown, F—F, for the coolant flow input region, is substantially the same as would be obtained were a crosssection taken of the output region, that is, showing flow in region 60 and in axial flow output jacket 68. The major difference is that the direction of arrows showing coolant flow would be reversed, that is, showing outgoing coolant instead of incoming coolant. It should be noted that once the coolant has passed the anode heat exchange surface, control of the liquid flow characteristics is no longer critical and techniques such as flow diverter 118 may not be required.

Figure 7:
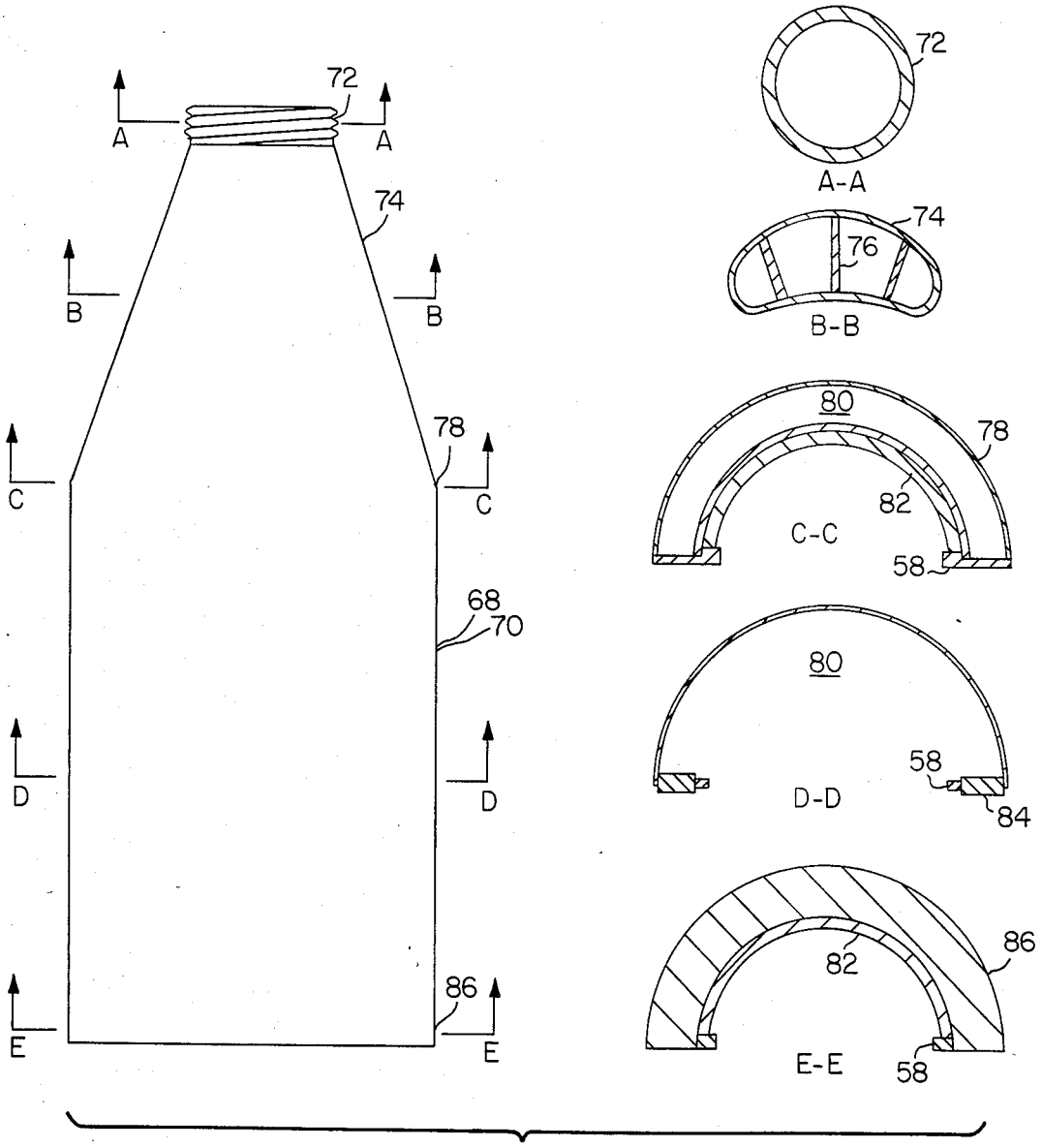
FIG. 7 is a complete top view of either the axial flow input or output jacket.

FIG. 7 is a complete top view of either the axial flow input 70 or output 68 jacket. The input 68 and output 70 jackets are shown separately in FIG. 1 Referring to FIGS. 1 and 7, input coolant enters liquid input jacket 70 at hose conenction 72. Coolant then traverses transition region 74 which may contain flow diverting vanes 76 to obtain desired flow patterns. Coolant then transitions into semi-circular input conduit 80 through anode sealing junction 78, said junction containing semi-circular sealing means 82, such as an elastomer. Semi-circular axial flow input conduit 80 feeds radial flow input conduits 64. The output conduit 60 in the axial flow input region 80 are sealed by IO diverter bands 66. After entering radial input conduit 64, the coolant flows through the fins of radial liquid flow diverter 50 where any circumferential component liquid velocity is substantially removed. After passing through heat exchange conduit 22, the heated coolant proceeds radially outward in discharge conduit 60 where it transitions into output jacket 68 through axial flow output conduit 80. From there it passes through transition region 74 and out hose connection 72 to a heat exchanger.

Figure 8:
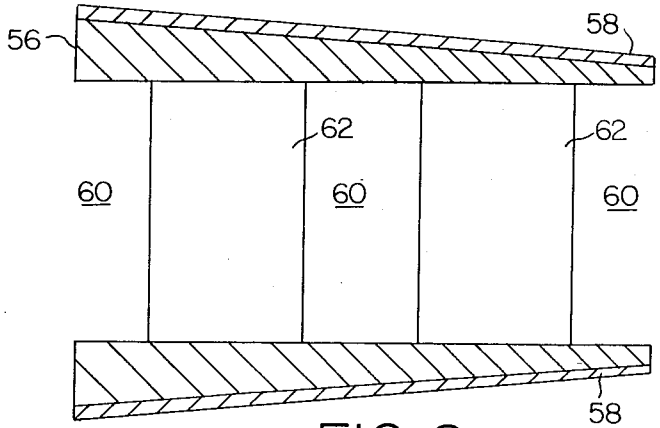
FIG. 8 is a complete cross-sectional view of the IO diverter showing a conical outer surface and attached axial sealing means such as elastomer strips, said view being at right angles to FIG. 5 and through the elastomer strips.

The axial flow input 70 and output 68 jackets are shown as two separate but idential parts in FIGS. 1 and 7. They may be connected by a hinge to make a clamshell structure that can clamp around the anode duct assembly as shown in FIG. 1. The axial seal 58 separating the input and output jackets is seen in FIGS. 5 and 7. Axial member 84, FIG. 7 D—D, provides the axial sealing surface for the input and output jackets. An alternative approach to mounting the axial flow input and output jacket on the anode conduit assembly is to construct the input-output liquid flow diverter 56 in such manner that the outer surface is conical, FIG. 8. Elastomer sealing means 58 would be mounted on previously described. The axial flow input and output jacket could now be one circular piece, with the axial input and output flow region 80 being constructed of a cylindrical member with axial members 84 (FIG. 7) tapered to mate with the conical surface 56 (FIG. 8), thus maintaining proper sealing relationship with axial elastomer strip 58. The terminating end 86, FIG. 7 E—E, of the axial flow jacket 68, will require a larger inside diameter than the transition end 78 to accommodate the tapered IO diverter 56. Thus, the cylindrical input-output jacket is slipped onto the anode sub-assembly where mating seals are made.

The general nature of the present invention is such that relatively low pressure drops can be expected across the heat exchange conduit 22. To maintain essentially uniform circumferential heat transfer across the heat exchange surface, uniform circumferential pressure is desired inasmuch as limiting heat transfer, i.e. burn out, is determined by that section of the heat exchange surface with the lowest coolant velocity. To establish uniform radial flow rates around the circumference of the anode and into the heat exchange conduit 22 (FIG. 1), liquid flow diverting means such as fins or curved vanes, such as shown in FIG. 7 B—B and illustrated as vanes 76, may be incorporated into the axial flow conduit 80 (FIG. 1) for both the input and jackets 68 and 70. Radial flow diverters 50 FIGS. 1 and 4 may be incorporated in the radial input 64 and output 60 conduits. A further means to minimize circumferential pressure variations in the heat exchange conduit 22 is to maintain input and output axial flow conduit 80 and radial input 64 and output 60 conduits at low pressure drops. Since pressure drops are proportional to the velocity squared of the coolant flow, the cross-section of the heat exchange conduit 22 is made small compared to the cross-sections of the axial flow conduit 80 and the radial flow conduits 60, 64. A large cross-section ratio means a low relative velocity. To this end axial flow input and output conduits 80 are each made semi-circular, together constituting the circumference of the coolant conduit.

Thus, only a modest height of conduit 80 is needed to provide a large cross-section. Moreover, the semi-circular geometry of the conduit simplifies control of the liquid flow when transitioning from axial flow to uniform 360° radial flow.

The present invention may also be adapted to multsegment depressed collectors (anodes) as shown in FIG. 15 of U.S. Pat. No. 4,455,504 mentioned above and described in Column 19, line 49 to Column 20, line 37 wherein parallel coolant flow replaces series coolant flow, Column 20, line 37 to line 61. Insulators 156, 160 and 164 of FIG. 15 may be fabricated with radially extended surfaces similar to washers 36 of FIG. 1 of the present invention or, alternately may be made of other insulating material such as epoxy or machinable ceramic and adhesively bonded in plce. Because of the conical and truncated cone geometry shown, the outwardly extended surface of the insulating washer (i.e., 36) may not be radial, but at an angle to the radius, that is, it bisects the angle between segments thereby maintaining symmetry. It is also desirable that other elements in close proximity to or in contact with the anode elements 159, 161 and 166 of FIG. 15 of U.S. Pat. No. 4,455,504, such as end plates 46, 48 and septum elements 16 be made of dielectric materials so as to provide adequate electrical isolation of the various anode elements. The use of dielectric coolants, such as fluorocarbons, also serves to provide needed electrical isolation between anode element.

Figure 9:
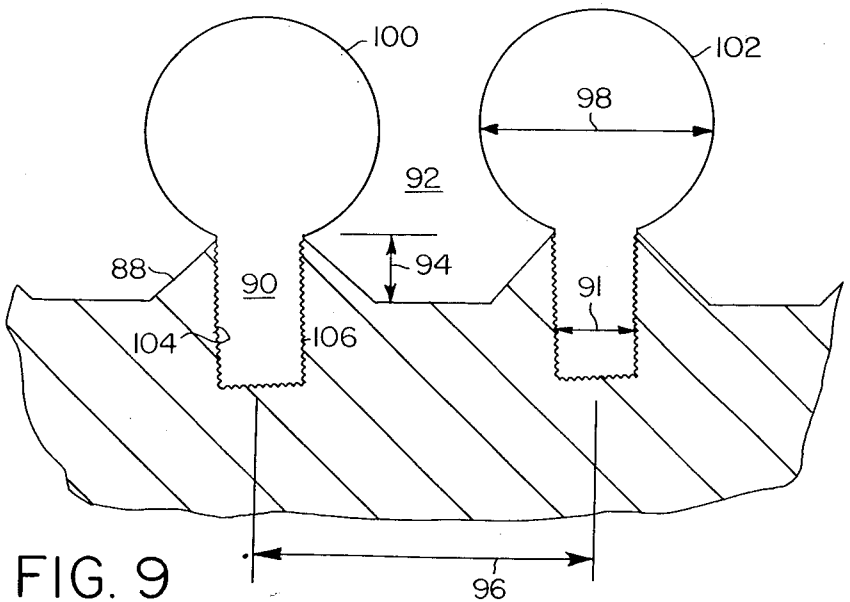
FIG. 9 is a partial cross-section view of surface roughness elements disposed on the anode heat exchange surface in the form of approximate truncated cones containing cavities exposed to the liquid coolant.

A preferred embodiment of surface roughness elements is shown in FIG. 9.

Figure 11:
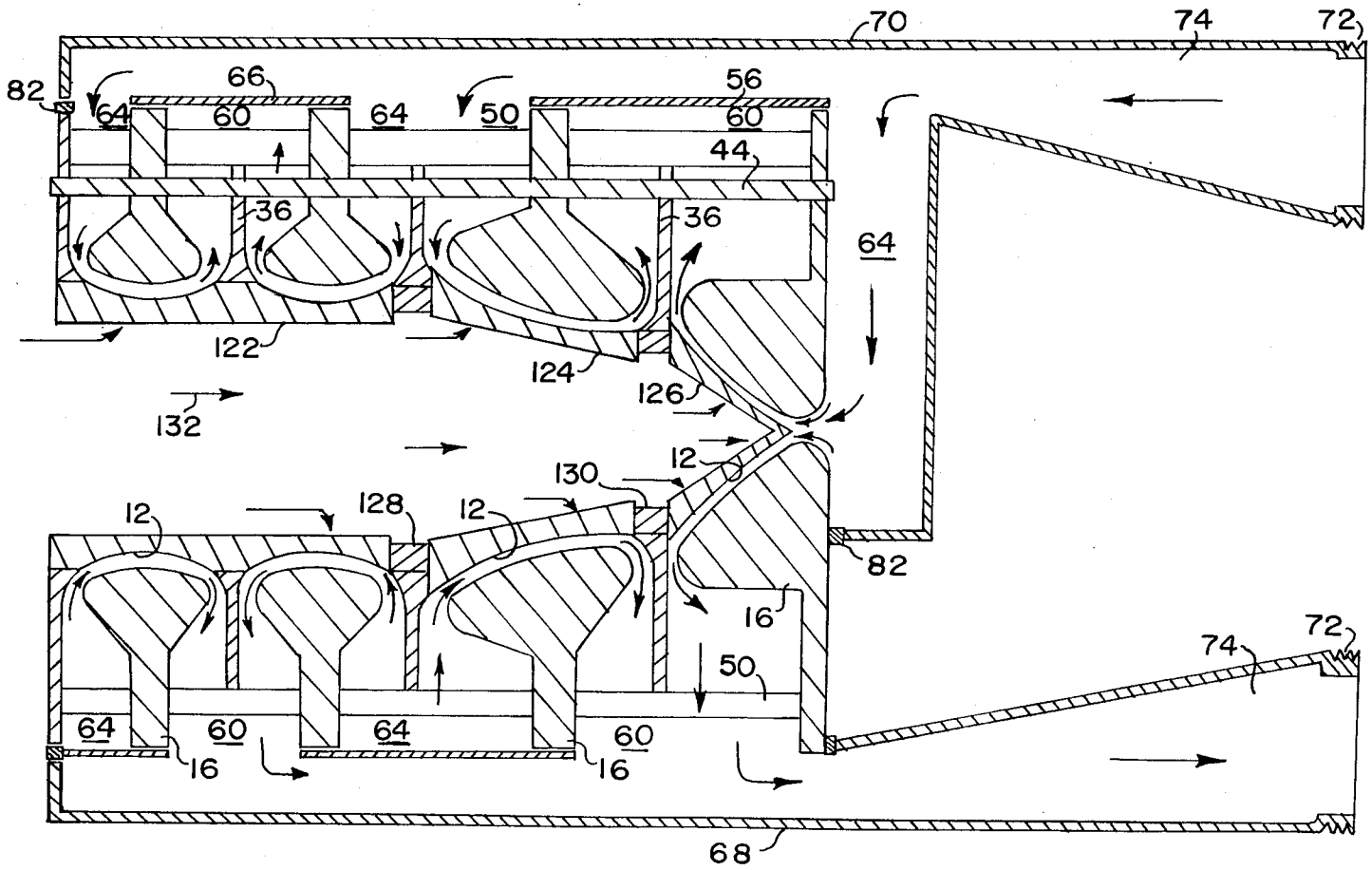

FIG. 11 is a complete cross-sectional view of the present invention as applied to a segmented or depressed collector (anode). The design is substantially the same as for the cylindrical anode shown in FIG. 1, any differences being dictated by differences in the anode geometry. Referring now to FIG. 11, the anode is shown as being segmented into three elements; cylindrical segment 122, truncated cone segment 124 and conical segment 126. Insulating ceramics 128 and 130 electrically isolate anode segments 122, 124 and 126. Electron beam 132 is shown being intercepted by anode elements 122, 124 and 126. Anode segment 122 is shown as having two curves on its surface whereas anode elements 124 and 126 are shown as having one. Depending on anode segment dimensions, each segment may have any number of periodic curves. Washers, 36, serve the same purpose as previously described. However, ceramic insulators 128, 130 also serve as radial stiffening members thereby loosening the design constraints with respect to strength on washers 36 mounted on said ceramics. Since conical 126 structures have high inherent strength, it is not anticipated that sitffening will be required at the apex though it is provided at the base by insulating ceramic 130.

Septa 16 are shown of various shapes to conform to the geometry of anode segments 122, 124 and 126. However, curved septum flow diverter surface 14 is positioned as in FIG. 1 to provide the desired conduit geometry 22 in the proximity of the anode heat exchange surface 12. Cylindrical input-output liquid flow diverter 56 functions as previously described. Axial support rods 44, radial flow diverter 50 and, input 70 and output 68 jackets function as previously discussed.

The three geometries of anode segments described; cylindrical 122, truncated cone 124 and conical 126 are for illustration purposes. Other shapes such as curved, instead of linear, inside surfaces where the electron beam strikes may be desirable in terms of evening out the power density on the various anode segments. Beam bunching as occurs in klystrons and traveling wave tubes can result in very uneven beam interception in depressed collectors such as the three segment anode shown in FIG. 11. In general, anode segment 122 is at a higher potential than segment 124 with in turn is at a higher potential than anode segment 126, the larger the voltage differential, between segments, the higher the tube efficiency.

It may be desirable to vary the power dissipation of each of the segments or even over a portion of the anode segment. This may be accomplished by varying conduit geometry 22, changing the radius of the curved anode heat exchange surface 12 or providing flow diverting means such that higher liquid flow rates are obtained over the selected anode heat exchange surface 12. Since the pressure gradient in a liquid flowing over a curved surface is equal to changing the liquid velocity has the maximum effect, whereas changing the radius of curvature of the anode heat exchange surface 12, is a linear effect.

Because anode segments 122, 124 and 126 are electrically isolated from each other by ceramic insulators 128, 130 and operated at different potentials, some of the structural members contained in FIG. 11 must be insulators. Washers 36 mounted of ceramic insulators 128, 130 should be insulators. Since ceramic insulators 128, 130 provide radial stiffening, the corresponding washers 36 are not required for strength and may therefore be omitted if radial stiffening of axial support rods 44 is not required. Axial support rods 44 may be ceramic or high strength plastic, i.e., ceramic impregnated epoxy. The various septa 16 are preferably made of a insulator such as ceramic or ceramic impregnated epoxy. Radial flow diverter 50 is also preferably of a dielectric material such as a stiff thin sheet of plastic strip that has been folded into the desired "V" or "U" shape. Input 70 and output 68 jackets may be a non-conductor, such as ceramic impregnated epoxy or, with suitable electrical isolation precautions, made of metal.

The surface roughness is in the approximate form of a truncated cone 88 which contain a cavity 90 which is exposed to the liquid coolant 92. The dimensions of cavities 91 of truncated cone 88 generally range from about 0.002 mm to 0.2 mm. The height of the roughness elements 94 ranges from 0.3 the height of the viscous sublayer to no more than twice the combined height of the viscous sublayer and the transition zone. For example, water at a velocity of 50 ft/sec. has a viscous sublayer thickness of about $5\times10^{-3}$ mm and a transition zone thickness of about $25\times10^{-3}$ mm. Spacing 96 between adjacent cavities is determined by maximum nucleate bubble diameter 98 such that at maximum heat flux, adjacent bubbles 100 and 102 do not merge to form the destructive film boiling condition. Spacing 96 between cavities generally ranges between 0.03 mm and 3 mm. Bubble size is determined by liquid and environment characteristics such as viscosity, surface tension, density, pressure etc. Suitable methods for fabricating the cavities 90 include the use of laser drilling and mechanical drilling. The inside surface 104 of cavities 90 is further prepared with micro cavities 106, preferably re-entrant, with dimensions generally in the range of $10^{-4}$ to $10^{-2}$ mm. Micro cavities 106 serve as permanent vapor traps that remain in equilibrium with the liquid under all conditions, including those of lowest temperature and highest pressure, and serve as the initial nucleate boiling sites until the larger cavities 90 commence nucleate boiling. Thus, full scale nucleate boiling becomes a two-step affair, with initial nucleate boiling taking place at the trapped vapor sites 106, and then when sufficient vapor has been accumulated in the larger cavities 90, they take over. Micro cavities 106 act much like the starting motor in an automobile. Micro cavities 106 may be created by judicious selection of diamond, or other cutting material, particle size which is embedded in the drill bit. With the laser, reactive vapors or gases may be introduced which react with the anode material to create the desired pitting effect. Also, the outer surface of the truncated cone may also possess micro cavities due to the laser melting of material and subsequent deposition action at the edge of the cavity 90.

It will be understood that the above description is of preferred exemplary embodiments of the present invention and that the invention is not limited to the specific forms shown. Modifications may be made in the design and arrangement of the elements without departing from the spirit of the invention as expressed in the appended claims.

I claim:

1. A liquid cooled, stationary anode tube, comprising:

a. an anode assembly having generally circular symmetry about a longitudinal axis, with an anode heat exchange region including a heat exchange surface for external cooling of said anode by a moving liquid coolant characterized in part by an associated velocity vector, said heat exchange surface comprised of at least one periodic curve, each such curve with a respective origin and each having generally circular symmetry about said axis, wherein said curve(s) and said respective origin(s) and said velocity vectors lie generally in the same one of any of the planes passing through said axis;

b. coolant diverter means disposed in said heat exchange region outwardly proximate said heat exchange surface for controlling fluid flow to create a pressure gradient having a component generally perpendicular to said heat exchange surface upon flow interaction of said moving liquid with the curved heat exchange surface, wherein said diverter means circumferentially envelops each of said periodic curves to maintain essentially uniform flow characteristics across said heat exchange surface at all points about the circumference thereof; and c. ducting means for alternate injection and removal of coolant along a flow path across said heat exchange surface.

2. The tube of claim 1, wherein the inside diameter of said coolant diverter is less than the projected outside diameter of said anode, said coolant diverter being segmented into a plurality of arc segment members and joining members of identical cross-sectional configuration for securing said segments together and forming said diverter about said anode.

3. The tube of claim 1, further comprising axial support means disposed circumferentially about and bonded to said coolant diverter, radially spaced from said anode heat exchange surface such that there is no substantial affect on the liquid flor characteristics over said anode heat exchange surface by said axial support means.

4. The tube of claim 3, wherein said axial support means comprises end plates disposed at each end of the anode and bonded thereto and encompassing therebetween said anode heat exchange surfaces and associated liquid coolant diverters, said end plates and said liquid coolant diverters having a plurality of identical holes in circumferential registry receiving shaft means for supporting said liquid coolant diverters in precise relationship with said anode heat exchange surfaces and providing rigidity in the axial direction.

5. The tube of claim 1, further comprising circumferentially disposed space means bonded to said anode at the jucntion of each of the adjacent curved anode heat exchange surfaces, whereby rigidity in the radial direction is provided to the anode.

6. The tube of claim 4, wherein thin generally radially extending washers of suitable material are bonded to the anode at the junctions of the curved anode heat exchange surfaces, the washers also having said circumferentially spaced holes to accept said shafts and being bonded thereto for providing rigidity in the raidal direction and further improving rigidity in the axial direction thereby providing a self-supporting structure whose strength against collapse is substantially independent of the anode.

7. The tube of claim 6, further comprising radial flow diverter means circumferentially disposed between adjacent liquid coolant diverters to substantially remove any circumferential component of coolant velocity, said coolant velocity vector thereby lying substantially in any of the planes passing through the anode axis and rotated thereabout.

8. The tube of claim 7, wherein said radial flow diverter means comprises a thin sheet of structurally stable, environmentally passive material folded in accordian or "U" fashion, the distance between adjacent folds being smaller than the height, wherein the coolant flows radially through a channel whose width is smaller than the length thereof thereby smoothing out any circumferential component of liquid velocity.

9. The tube of claim 6, further comprising flow guidance means to alternately provide coolant input and output flow to conduits defined by adjacent liquid coolant diverters.

10. The tube of claim 8, further comprising flow direction means for directing coolant alternately radially inwardly and radially outwardly through adjacent conduits defined by said coolant diverters, said flow direction means comprised of a walled cylindrical member disposed over said diverters having alternate circumferential sections removed, each less than about 108° and opposite one another to define continuous axial strips separated by approximately 180°, each of the removed sections positioned over said conduits with the inside surface of said cylinder being bonded to said conduit diverter to seal adjacent conduits one from another.

11. The tube of claim 9, further comprising coolant input and output conduit jackets in sealing engagement with said assembly, including:

a. input/output connector means;

b. a flow transition region;

c. a generally semicircular conduit for directing coolant flow in an axial direction, wherein said coolant flow covers circumferentially approximately 180°; and d. radial flow directing means disposed in said transition region or said semicircular conduit, or both, to maintain uniform radial flow patterns.

12. The tube of claim 10, wherein said cylindrical member is configured with an outside surface in the shape of a truncated cone.

13. The tube of claim 10, wherein the conduit defined by adjacent liquid coolant diverters has circumferentially disposed flow translation means whereby coolant flowing in the approximately 180° section covered by said cylindrical sections is smoothly and uniformly translated from circumferential flow to radial flow such that uniform coolant flow is obtained over the entire circumference of each of the curved anode heat exchange surfaces.

14. The tube of claim 1, wherein said anode heat exchange surface includes bubble generator 8 means disposed on said heat exchange surface, for forming nucleate bubbles of predetermined size and distribution to thereby increase heat flux.

15. The tube of claim 14, wherein said anode heat exchange surface has intimately adherent thereto a thin porous metal layer.

16. The tube of claim 15, wherein said porous metal is of relatively uniform pore size.

17. The tube of claim 14, wherein said generating means comprises cavities of predetermined geometry and distribution created in said anode heat exchange surface, said cavities being spaced apart such that at maximum power dissipation the nucleate bubbles formed at said cavities do not coalesce to form an insulating vapor blanket.

18. The tube of claim 14, wherein said cavities on the anode heat exchange surface are of predetermined geometry to provide an optimum formation of nucleate bubbles.

19. The tube of claim 1, wherein said liquid tends to include a viscous sublayer adjacent to said heat exchange surface, said tube further comprising means disposed on said heat exchange surface for breaking up said viscous sublayer to promote removal of said nucleate bubbles.

20. The tube of claim 19, wherein said means for breaking up said viscous sublayer comprises roughness elements formed on said heat exchange surface projecting into said liquid.

21. The tube of claim 20, wherein the liquid cooled anode heat exchange region is further prepared with a calculated surface roughness whose height is no less than 0.3 that of the coolant liquid viscous sublayer and no greater than twice the combined tickness of the coolant liquid viscous sublayer and the transition zone.

22. The tube of claim 20, wherein said surface roughness elements are approximately in the shape of truncated cones whose bases are affixed to the anode, said cones containing approximately centered cavities which are exposed to the liquid, said cone height being no less than 0.3 the height of the viscous sublayer nor more than twice the combined height of the viscous sublayer and transition zone whereby more efficient heat transfer is obtained.

23. The tube of claim 22, wherein said cavities have dimensions in the range of from about 0.002 mm to about 0.2 mm, and said cones are spaced apart such that, at maximum heat flux, nucleate bubbles formed do not coelesce to form the condition of film boiling, said spacing ranging from about 0.3 mm to about 3 mm whereby more efficient heat transfer is obtained.

24. The tube of claim 22, wherein said cavity walls are formed with micro cavities whereby more efficient nucleate boiling is obtained.

25. The tube of claim 24, wherein the dimensions of said micro cavities are in the range of from about $1\times10^{-4}$ mm to about $1\times10^{-2}$ mm whereby more efficient nucleate boiling is obtained.

26. The tube of claim 21, wherein said radial flow directing means are comprised of fins or curved vanes.

* * * * *